United States Patent [19]

Marino

[11] 4,022,507

[45] May 10, 1977

[54] SELF-CINCHING CARGO SLING

[75] Inventor: Frank J. Marino, Sands Point, N.Y.

[73] Assignee: Marino Systems, Inc., New York, N.Y.

[22] Filed: Mar. 17, 1976

[21] Appl. No.: 667,858

[52] U.S. Cl. ..... 294/74; 224/49

[51] Int. Cl.[2] ..... B66C 1/18

[58] Field of Search ..... 294/31.2, 67 E, 67 EA, 294/74, 75, 76; 24/16 R, 17 A, 17 B, 19; 224/45 E, 45 N, 49, 55–58

[56] References Cited

UNITED STATES PATENTS

| | | | |
|---|---|---|---|
| 1,611,455 | 12/1926 | Keeler | 224/55 |
| 1,829,860 | 11/1931 | Herrmann | 294/74 X |
| 3,046,045 | 7/1962 | Campbell | 294/74 |
| 3,861,734 | 1/1975 | Welch | 294/74 |
| R26,704 | 11/1969 | Norton | 294/74 |

FOREIGN PATENTS OR APPLICATIONS

| | | | |
|---|---|---|---|
| 572,682 | 11/1958 | Belgium | 224/58 |
| 111,710 | 9/1944 | Sweden | 294/74 |

*Primary Examiner*—Johnny D. Cherry
*Attorney, Agent, or Firm*—Bell, Seltzer, Park & Gibson

[57] ABSTRACT

A self-cinching cargo sling adapted to encircle a load to facilitate the lifting thereof and comprising a length of flexible fabric webbing or the like which is arranged to define an inner loop and an outer loop superimposed about the inner loop. The inner and outer loops have overlapping portions which extend along about one-half of the periphery of the inner loop, and means are provided for maintaining the overlapping portions in relatively slideable, contiguous relationship. In operation, the loops are positioned to encircle a load, and a lifting force exerted on the outer loop to cinch the inner loop about the load. The frictional engagement between the overlapping portions of the loops acts to resist the release of the cinching force upon the release of the lifting force, and further prevents the lateral separation of the loops.

16 Claims, 17 Drawing Figures

SELF-CINCHING CARGO SLING

The present invention relates to a self-cinching cargo sling for supportingly engaging a load to facilitate the lifting thereof, and which is characterized by high strength, and the ability to resist the release of the cinched relationship about the load after the cinching or lifting force is released.

Load lifting slings of fabric webbing have heretofore been employed in a number of different load engaging configurations. For example, in one common configuration, a length of the webbing is disposed about the load in a U-shaped or basket arrangement, with the lifting force being exerted from the two remote ends of the webbing. Such slings however must be employed in pairs for most loads, and the load must be carefully balanced between the slings to prevent the load from sliding therefrom. In addition, basket slings are not generally usuable where the load comprises a plurality of individual components, such as a stack of lumber or fabric bolts, since the components of the load are not held together by the sling and thus they may be free to shift laterally with respect to each other.

In another well known configuration, the webbing of the sling is formed into an endless belt, and then looped upon itself to form a choker hitch as shown for example in FIG. 6 of U.S. Pat. No. Re. 26,704 to Norton. The choker configuration serves to cinch and lock the sling about the load while the lifting force is applied, but upon release of the lifting force, the cinching force is also released to thereby result in the possible separation of the sling from the load, as well as the possible shifting of the components of the load. Further, the sharp angular bend of the webbing in a choker configuration tends to dissipate its tensile strength, usually by as much as thirty to forty percent. Thus a heavier webbing is required than would normally be the case.

It has further been proposed to dispose an endless sling in a superimposed configuration defining inner and outer loops, with the outer loop encircling the inner loop, note for example the U.S. Pats. to Herrmann, No. 1,829,860 and Campbell, No. 3,046,045. Such an arrangement also achieves a cinching force about the load, but here again, when the lifting force is released, the cinching force is also released. In addition, the outer loop tends to become laterally separated from the inner loop when the lifting force is exerted from a direction other than vertical, thereby releasing the effective cinching force.

It is accordingly an object of the present invention to provide a cargo sling which is self-cinching about the load upon exerting a lifting or cinching force on the sling, and wherein the cinching force is maintained after the lifting or cinching force is released. Thus the sling is maintained in assembly with the load and in position for ready access when the load is to be again lifted. Also, the cinching force effectively precludes shifting of the components of the load between lifting operations.

It is another object of the present invention to provide a cargo sling which is able to be cinched about a load without imparting any sharp angular bends in the material of the sling, and such that there is no significant loss of strength in the material.

It is a more particular object of the present invention to provide a self-cinching sling which comprises a fabric webbing or the like disposed in partially overlapping inner and outer loops, and wherein the overlapping portions are guidingly maintained in relatively slideable, contiguous relationship such that the resulting frictional engagement between the overlapping portions tends to resist the release of the cinching force upon the release of the lifting force. Also, such maintaining of the overlapping portions serves to hold the sling in a relatively open non-tangled configuration when not in use to facilitate its assembly about a load and its subsequent engagment by a lifting hoist, and it further precludes the lateral separation of the overlapping portions upon the application of a lifting force from a direction other than vertical.

It is also an object of the present invention to provide a cargo sling which may be used singly or in pairs about the load, and which may be readily disposed about a generally cylindrical load such as a roll of paper or carpet, or a rectangular load such as a pile of lumber or cloth bolts.

These and other objects and advantages are achieved in the embodiments of the invention described herein, and wherein the sling comprises a unitary elongate flexible load bearing member having a medial portion and an outer portion on each side of the medial portion. The medial portion is disposed in a loop, and the outer portions extend in opposing paths along the periphery of the loop such that each outer portion has a first segment intimately contacting or overlapping a portion of the periphery of the loop and a second segment extending to a terminal point positioned outwardly beyond the side of the loop which is opposite the overlapping portions. In one embodiment, a sleeve is positioned about at least a substantial part of the overlapping portions of the member to maintain the overlapping portions in relatively slideable, contiguous relationship to thereby achieve a frictional engagement therebetween. In another embodiment, one or more slits are provided in the member and another portion of the member extends through each of the slits to thereby maintain the desired relationship of the overlapping portions. The outer portions of the member may be joined to form an endless arrangement, or alternatively, the outer portions may each terminate in a remote free end which is adapted to be independently engaged by the lifting hook of a hoist or the like.

In use, the load bearing member is positioned to encircle the peripheral outline of the load about 1½ times, and such that the overlapping portions extend along about one half such peripheral outline. A lifting force is then exerted on each of the outer portions to draw the loop into cinching relationship about the load, and the continuing frictional engagement between the overlapping portions serves to resist the release of the cinching force upon the release of the lifting force.

Some of the objects of the invention having been stated, other objects will appear as the description proceeds, when taken in connection with the accompanying drawings, in which —

Figure 1:
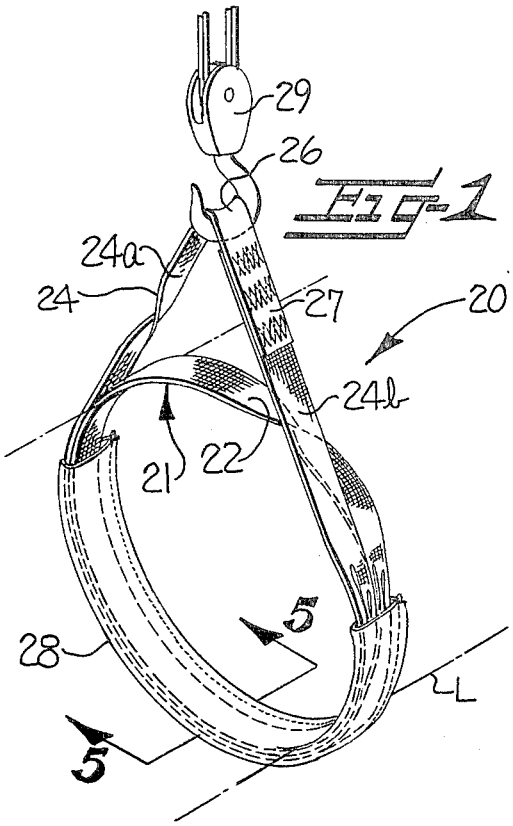
FIG. 1 is a perspective view of a cargo sling embodying the features of the present invention.

Referring more specifically to the drawings, FIG. 1 illustrates one embodiment of a cargo sling 20 embodying the present invention. More particularly, the sling 20 comprises a unitary elongate flexible load bearing member 21 having a medial portion in the form of a generally circular inner loop 22, and outer portions 24*a*, 24*b* extending in opposing paths along the periphery of the inner loop 22. Further, each outer portion has a first arcuately curved segment which intimately contacts or overlaps a substantial portion of the periphery of the inner loop and a second tangentially disposed segment extending to a terminal or lifting point 26 positioned outwardly beyond the side of the inner loop which is opposite the overlapping portions. The ends of the member 21 are interconnected at 27 to form an endless arrangement, such that the outer portions 24*a*, 24*b* define an outer loop 24 which is disposed in generally superimposed relation about the inner loop 22.

A sleeve 28 encloses the overlapping portions of the inner and outer loops, which as shown in the drawings, preferably includes at least about one-half of the periphery of the inner loop 22. The sleeve 28 is dimensioned to closely and slideably receive the overlapping portions of the member 21, to thereby maintain the overlapping portions in a relatively slideable, contiguous relationship with respect to each other and thus assure a frictional engagement therebetween for the purposes hereinafter further explained.

In a preferred embodiment, the load bearing member 21 of the sling 20 comprises a fabric webbing of the type commonly employed in lifting slings. Typically, the fabric webbing is woven from nylon or polyester yarns, and has a width of between about one to two inches and a thickness of between about 5/32 and 7/32 inches. Such webbing has a tensile strength of between about 6,000 and 8,000 pounds per inch of width. As will be apparent, the load bearing member of the sling may comprise a number of other suitable materials, such as wire cable or rope.

Figure 5:
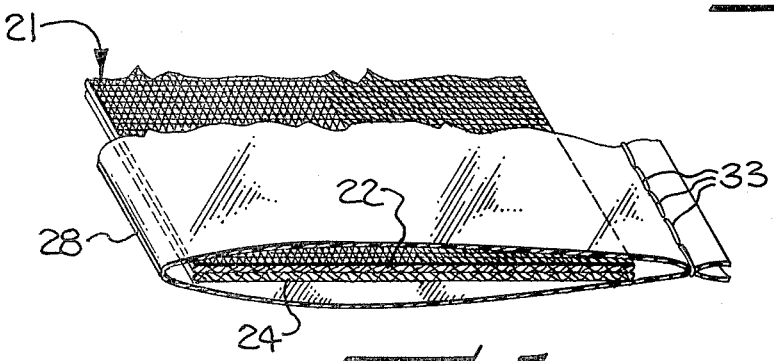
FIG. 5 is an enlarged fragmentary and sectional perspective view taken substantially along the line 5—5 of FIG. 1 and illustrating the overlapping portions of the webbing and the enclosing sleeve.

As illustrated, the sleeve 28 comprises a length of plastic or similar sheet material which is folded lengthwise over the overlapping portions of the member 21, with the adjacent longitudinal edges being interconnected by stitching at 33 to form a flat tube which closely receives the overlapping portions, note FIG. 5. As a specific example, the plastic material may be fabricated by weaving 1000 denier polyethylene yarn into a fabric having ten yarns per inch in both the wrap and weft directions, and then coating the fabric with a film of polyethylene. It will be understood however that the sleeve may comprise other constructions, such as extruded plastic tubing or tubular fabric material.

Figure 3:
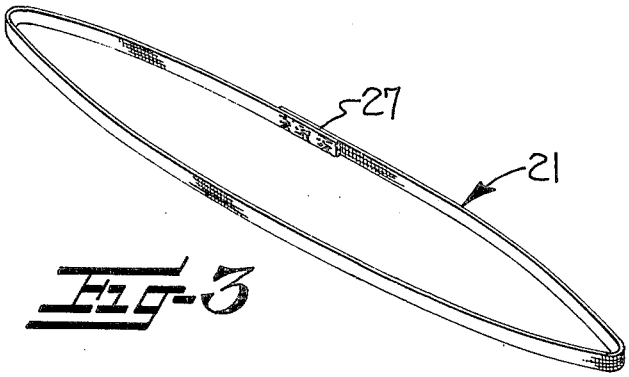
FIG. 3 is a perspective view of an endless fabric webbing, and in a position representing an initial step in the fabrication of the sling shown in FIG. 1.
Figure 4:
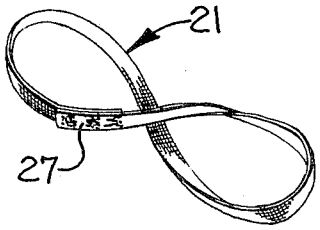
FIG. 4 illustrates the webbing of FIG. 3 formed into a figure eight, and represents a subsequent step in the fabrication of the sling shown in FIG. 1.

FIGS. 3 and 4 illustrate the initial steps involved in the fabrication of the sling 20 as shown in FIG. 1. In particular, FIG. 3 shows a length of fabric webbing 21 formed into a single closed loop, with the ends being joined together at 27 by stitching. Next, the single loop is crossed to form a figure eight as shown in FIG. 4, and the two loops of the figure eight are then brought together to form a superimposed figure eight which comprises the inner loop 22 and outer loop 24 of the sling. Finally, a length of sleeve material is positioned about the overlapping portions of the loops, and is sewn along the edges as at 33 to form the flat sleeve 28 which closely receives the overlapping portions.

It will be noted that the sling 20 of FIG. 1 includes two twists in the fabric webbing 21 which are inherently formed during the above described method of fabricating the sling. In addition, the webbing 21 will necessarily cross upon itself, with the crossing point located either within the sleeve 28 or at a point immediately adjacent one of the open ends thereof.

In use, the sling 20 is initially disposed in encircling relation about the load L as shown in dashed lines. A lifting force is then applied to the outer loop 24, and as the force is applied, the overlapping portions of the webbing 21 slide relative to each other to thereby reduce the diameter of the inner loop and draw the same into cinching relationship about the load. The lifting force is typically applied by the lifting hook of a hoist 29 or the like and is applied from a point on the opposite side of the load from the overlapping portions of the member 21 and sleeve 28. While the splice at 27 in the webbing is shown as being immediately adjacent the lifting hook for clarity of illustration in the drawings, it will be understood that the splice is desirably spaced a further distance from the hook to avoid contact therebetween and possible damage to the splice.

When the lifting force is released, the sleeve 28 acts to hold the overlapping portions of the webbing in contact, to thereby assure a continuing frictional engagement therebetween, which in turn serves to effectively resist relative sliding movement in the reverse or releasing direction. In this regard, the fact that the webbing is usually crossed upon itself within the sleeve as noted above also tends to resist any relative sliding movement. Thus the cinching force about the load is maintained upon the release of the lifting force. When it is desired to remove the sling from the load, the cinching force may be readily released by manually pulling upon the inner loop 22.

As a further aspect of the present invention, the sleeve 28 of the sling may be slid along the webbing 21 to change the relative positioning of the inner and outer loops with respect to the webbing, and thus the point at which the lifting force is applied. Thus any abrasion damage to the webbing resulting from contact with the lifting hook may be dispersed along the length of the webbing to thereby increase the useful life of the sling. Also, the sleeve further serves as a protective barrier or buffer between the webbing and load.

Figure 2:
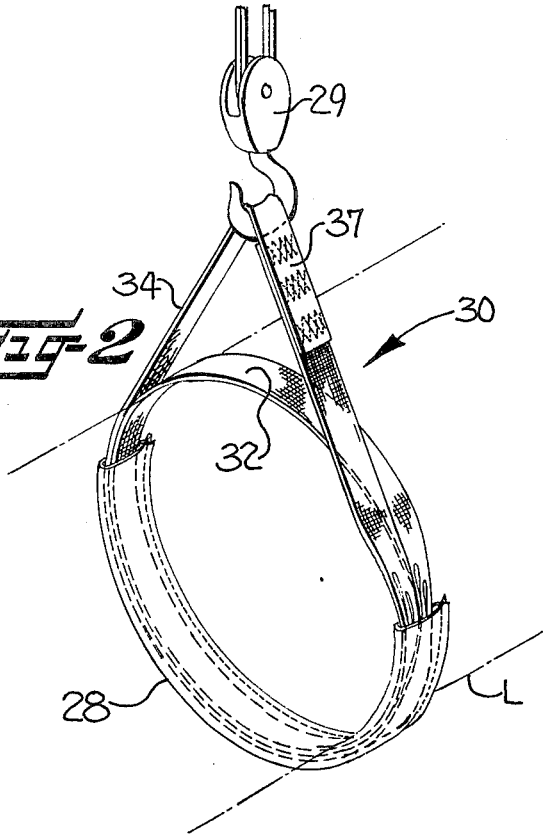
FIG. 2 is a perspective view of another embodiment of a cargo sling embodying the present invention.

FIG. 2 illustrates an alternative embodiment of the present invention and wherein the twists in the webbing of the sling 20 of FIG. 1 are eliminated. In particular, FIG. 2 shows a non-twisted sling 30 comprising inner and outer loops 32, 34 respectively, and which is fabricated by initially forming a cut length of fabric webbing into an overlapping looped configuration, and then joining the ends of the webbing by stitching or the like at 37. The resulting sling 30 is otherwise similar to the sling 20 of FIG. 1, and in this regard, it will be noted that the webbing of the sling 30 necessarily crosses upon itself within its sleeve as in the case of the sling 20.

Figure 6:
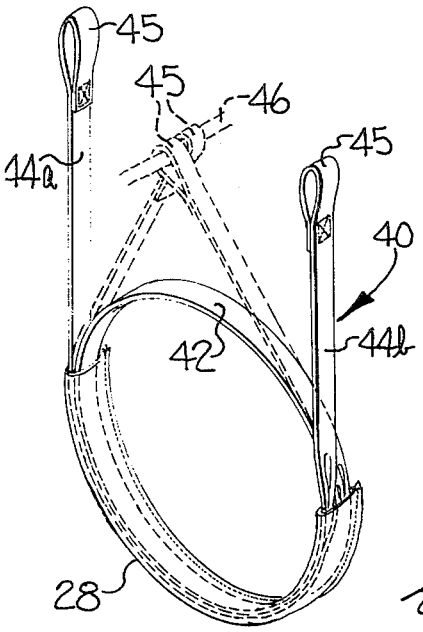
FIG. 6 is a perspective view of a further embodiment of a sling embodying the present invention.

FIG. 6 illustrates another embodiment of the present invention which comprises a sling 40 wherein the outer portions 44a, 44b of the webbing each terminate in a free end. Also, each free end is folded upon itself and then stitched together to form a closed loop 45. Thus the free ends may be readily engaged by the spaced arms of a fork lift truck or the like, or the two ends may be secured to a single lifting means 46 as shown in the dashed lines.

Figure 7:
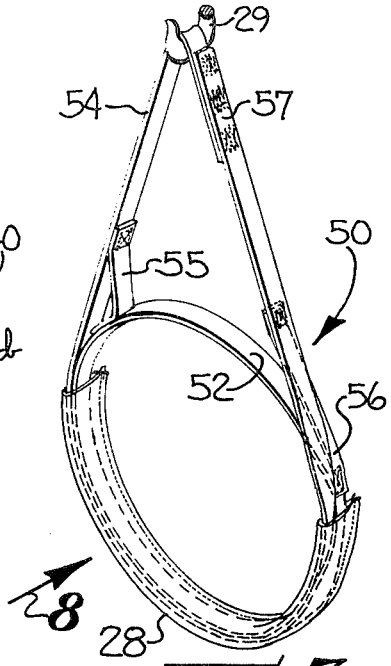
FIG. 7 is a perspective view of a sling similar to that shown in FIG. 2, but further including means for limiting the cinching force applied to the load.
Figure 8:
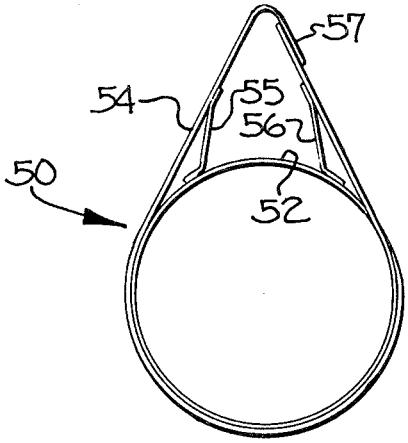
FIG. 8 is a front elevation view of the sling shown in FIG. 7 and taken in the direction of the arrow 8, but with the sleeve removed for clarity of illustration.

The sling 50 shown in FIGS. 7 and 8 includes means for limiting the cinching force applied by the sling to the load. More particularly, this limiting means comprises a pair of fabric webbing tabs 55, 56 interconnecting the non-overlapping portions of the inner and outer loops 52, 54. More particularly, the tabs are spaced apart so as to be positioned on opposite sides of the point on the outer loop where the lifting force is to be applied. As will be apparent, this arrangement limits the closing of the inner loop beyond a predetermined diameter, which is desirable in many instances where a relatively fragile load is being lifted.

Figure 9:
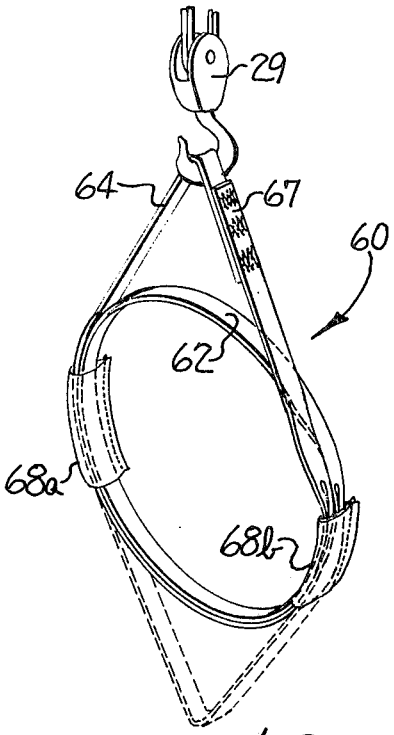
FIG. 9 is a perspective view of still another embodiment of the present invention, and wherein the overlapping portions of the webbing are held in contact by a pair of spaced apart sleeve segments.

FIG. 9 illustrates a sling 60 representing still another embodiment of the present invention and wherein the sleeve comprises a pair of spaced apart flat tubular segments 68a, 68b. If desired, the sleeve segments may be attached to one of the loops 62, 64 to maintain a predetermined peripheral separation, which is usually predetermined to be sufficient to position the segments on opposite sides of the load. Also, the sleeve segments *68a, 68b* maintain the overlapping portions of the webbing in a relatively slideable, contiguous relationship and thereby assure a frictional engagement therebetween for the purposes noted above. This embodiment has a further advantage in that the sling 60 is readily adapted to be lifted from opposite directions by sliding the outer loop 64 through the sleeve segments as indicated in dashed lines.

In the embodiments illustrated in FIGS. 13–17, the means for maintaining the overlapping portions of the webbing in a relatively slideable, contiguous relationship comprises slit means disposed in a portion of the webbing, with another portion of the webbing extending through the slit means. More particularly, in FIG. 13, the sling 70 comprises inner and outer loops 72, 74 respectively, with the outer loop 74 disposed substantially about the inner loop 72, and with the inner loop 72 having a continuous slit 73 extending along about one-half the periphery thereof when the sling is in its operative position about a load. The outer loop 74 extends through the slit 73 so as to extend beyond the periphery of the inner loop and be engagable by the hoist 29.

Figure 14:
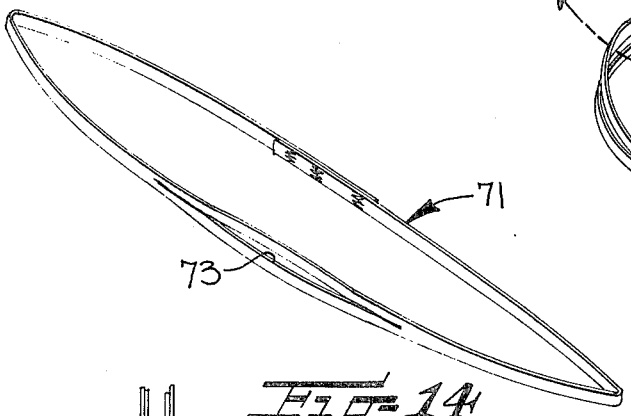
FIG. 14 is a perspective view of an endless fabric webbing having a slit therein, and in a position representing an initial step in the fabrication of the sling shown in FIG. 13.
Figure 15:
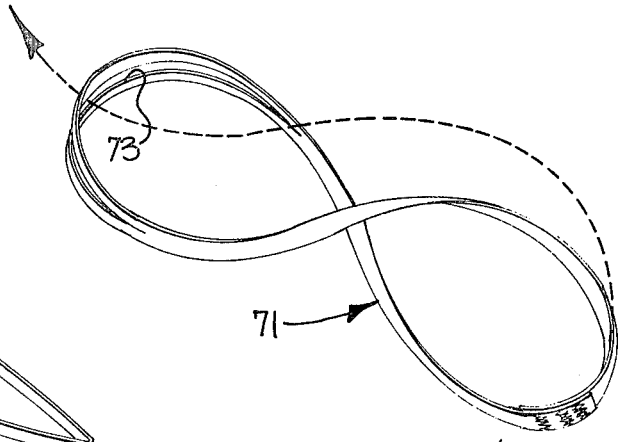
FIG. 15 illustrates the webbing of FIG. 14 formed into a figure eight, and represents a subsequent step in the fabrication of the sling shown in FIG. 13.
Figure 13:
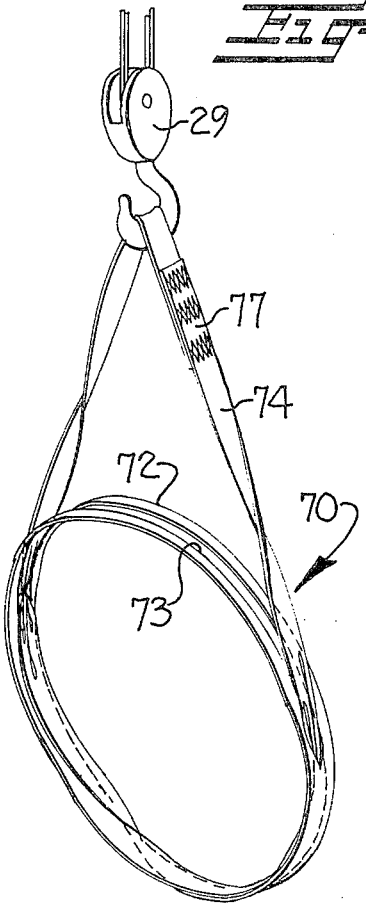
FIG. 13 is a perspective view of another embodiment of a sling embodying the present invention.

As illustrated in FIGS. 14–15, the sling 70 of FIG. 13 may be fabricated by initially forming the webbing 71 into an endless arrangement, and then slitting the webbing along a portion of its length as seen at 73 in FIG. 14. Next, the webbing 71 is formed into a FIG. eight, and one of the resulting loops inserted through the slit 73 in the manner indicated by the dashed line to form the sling 70.

Figure 17:
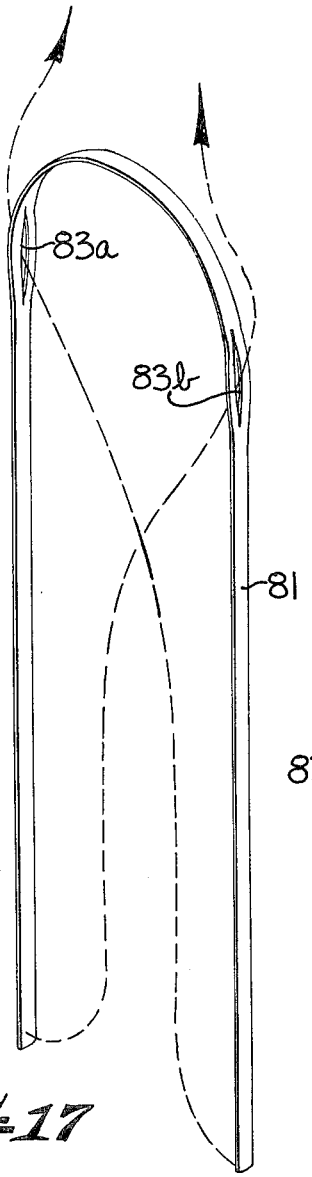
FIG. 17 is a perspective view of a length of fabric webbing in a position representing an initial step in the fabrication of the sling shown in FIG. 16.
Figure 16:
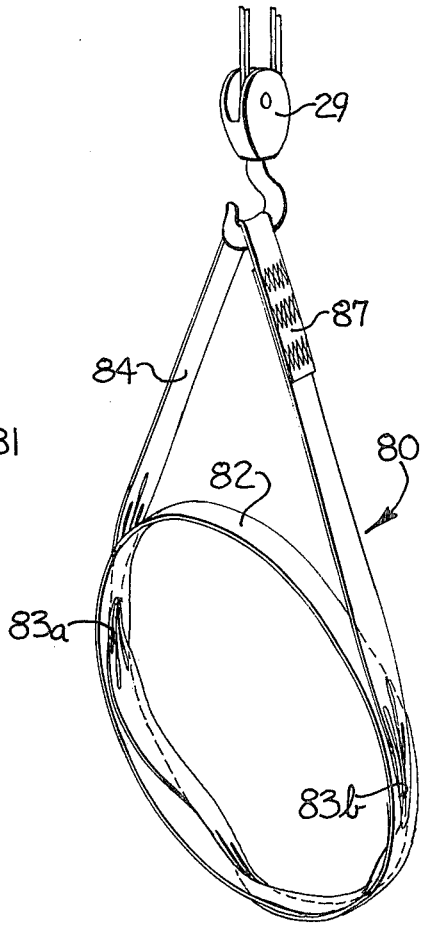
FIG. 16 is a perspective view of a further embodiment of a sling embodying the present invention.

FIG. 16 illustrates a sling 80 wherein the slit means comprises a pair of spaced apart slits 83*a*, 83*b* in the inner loop 82, with the slits being positioned at opposite sides of the loop when the sling is in its operative position about a load. The outer loop 84 of the sling 80 extends through each of the slits. FIG. 17 illustrates a method for fabricating the sling 80 of FIG. 16, and wherein a length of webbing 81 is first slit at predetermined spaced apart locations 83*a*, 83*b*, and each end is then inserted through the remote slit as indicated by the dashed lines. The ends are then interconnected by stitching or the like at 87 to form the completed sling.

Figure 10:
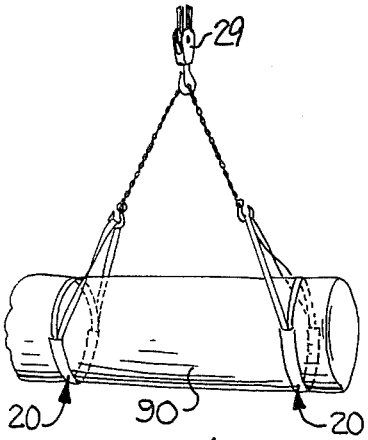
FIG. 10 is a perspective view illustrating the manner in which a pair of slings embodying the present invention may be employed to lift an elongate cylindrical load.
Figure 11:
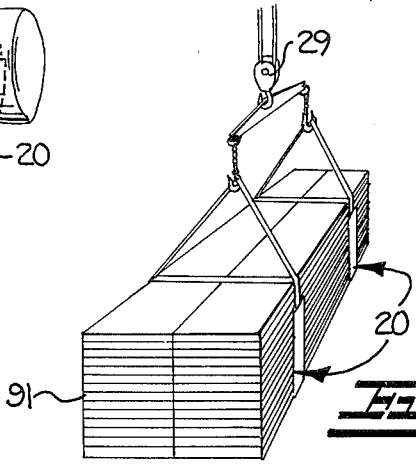
FIG. 11 is a perspective view illustrating the manner in which a pair of slings embodying the present invention may be employed to lift a load of rectangular configuration.
Figure 12:
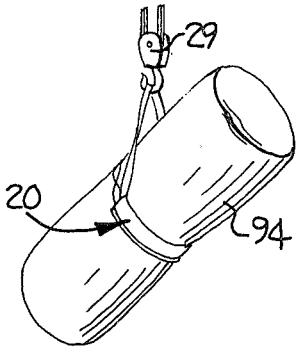
FIG. 12 is a perspective view illustrating the manner in which a single sling of the present invention may be employed to lift an elongate cylindrical load.

FIGS. 10–12 disclose various load configurations which are able to be readily supported and lifted utilizing the sling of the present invention. Thus for example, FIG. 10 shows a pair of slings 20 disposed about an elongate cylindrical load 90, such as a roll of paper or carpet, and FIG. 11 shows a pair of slings 20 disposed about a rectangular load 91 of independent and relatively movable components, such as lumber or fabric bolts. In each case, the webbing 21 of the sling encircles the peripheral outline of the load about 1½times, and such that the overlapping portions and sleeve 28 extend along about one half the peripheral outline. The non-overlapping portion of the outer loop 24 extends in a generally vertical direction from each side of the load and is engaged by one of the spaced hooks carried by the hoist 29. It will also be noted that in the embodiment illustrated in FIG. 11, the slings not only serve to support and lift the load 91, but the self-cinching feature serves to maintain the relative positioning of the various components of the load even after the lifting force is released.

FIG. 12 shows a single sling 20 supportingly engaging and lifting an elongate cylindrical load 94. In this case, the load will usually tilt as shown, causing the lifting force to be applied from a direction other than the vertical with respect to the sling. However, the sleeve 28 serves to preclude the lateral separation of the loops, and the tight cinching engagement between the overlapping portions of the webbing maintained.

As will be apparent, the slings illustrated in FIGS. 6–9 and 13–17 are similarly adapted to support and lift a load in the manner described above. In the case of the slings 70 and 80, the interconnection resulting from the passage of the webbing through the slit means serves to maintain the overlapping portions of the webbing in the desired contiguous relationship as described above. Thus the sleeve may be omitted, although a sleeve could if desired be additionally employed.

In the drawings and specification, there has been set forth a preferred embodiment of the invention, and although specific terms are employed, they are used in a generic and descriptive sense only and not for purposes of limitation.

That which is claimed is:

1. A self-cinching cargo sling adapted to encircle and supportingly engage a load to facilitate the lifting thereof and characterized by high strength, and the ability to resist the release of the cinched relationship about the load after the cinching or lifting force is released, and comprising a unitary elongate flexible load bearing member having a medial portion and an outer portion on each side of said medial portion, said medial portion being disposed in a loop, and said outer portions extending in opposing paths along the periphery of the loop and such that each outer portion has a first segment intimately contacting a portion of the periphery of the loop and a second segment extending to a terminal point positioned outwardly beyond the side of the loop which is opposite said intimately contacting portions, and with said first segments collectively extending along about one-half the periphery of the loop when the sling is in its operative position about the load, and means operatively associated with the load bearing member for maintaining said intimately contacting portions in a relatively slideable, contiguous relationship to thereby achieve a frictional engagement therebetween and comprising a sleeve enclosing substantially the full extent of said intimately contacting portions, whereby the loop may be positioned to encircle a load, and a lifting force exerted on each of the outer portions from the associated terminal point to draw the loop into cinching relationship about the load and such that the frictional engagement between the intimately contacting portions serves to resist the release of the cinching force upon the release of the lifting force.

2. The cargo sling as defined in claim 1 wherein each of said outer portions terminates in a remote free end.

3. The cargo sling as defined in claim 2 wherein each of said free ends includes loop means for operatively engaging a lifting hook or the like.

4. The cargo sling as defined in claim 1 wherein said outer portions are interconnected such that the load bearing member is endless.

5. A self-cinching cargo sling adapted to encircle and supportingly engage a load to facilitate the lifting thereof and characterized by high strength, and the ability to resist the release of the cinched relationship about the load after the cinching or lifting force is released, and comprising an endless flexible load bearing member arranged to define an inner loop and an outer loop disposed substantially about the inner loop, said inner and outer loops having overlapping portions which extend along about one-half the periphery of said inner loop when the sling is in its operative position about a load and means operatively associated with the load bearing member for maintaining the overlapping portions in a relatively slideable, contiguous relationship to thereby achieve a frictional engagement therebetween, and comprising a sleeve slideably receiving substantially the full extent of said overlapping portions, whereby the loops may be positioned to encircle a load, and a lifting force exerted on the outer loop to draw the inner loop into cinching relationship about the load and such that the frictional engagement between the overlapping portions serves to resist the release of the cinching force upon the release of the lifting force.

6. The cargo sling as defined in claim 5 wherein said load bearing member comprises a length of fabric webbing having the ends thereof interconnected.

7. The cargo sling as defined in claim 6 wherein said sleeve comprises a continuous length of flat tubing closely receiving substantially the full length of the overlapping portions of said loops.

8. The cargo sling as defined in claim 7 wherein said flat tubing comprises a sheet of plastic material folded lengthwise and with the adjacent longitudinal edges thereof interconnected.

9. A method for supportingly engaging a load to facilitate the lifting thereof, and comprising the steps of disposing a unitary elongate flexible load bearing member so as to encircle the peripheral outline of the load about 1½ times, and such that the load bearing member is overlapped along about one half such peripheral outline and with an outer portion of the member extending outwardly from each side of the load in a generally common direction, exerting a lifting force on the outer portions of the load bearing member to draw the member into tight cinching relationship about the load, and while guidingly maintaining the overlapping portions of the member in slideable and contiguous relationship with respect to each other, including enclosing substantially the full extent of the overlapping portions within a relatively close fitting sleeve.

10. The method as defined in claim 9 wherein the lifting force is exerted on the outer portions of the load bearing member from a point on the opposite side of the load from the overlapping portions of the member.

11. The method as defined in claim 9 wherein the step of disposing the load bearing member about the load includes forming the member into an endless configuration comprising inner and outer loops, with the outer loop superimposed substantially about the inner loop, and then placing the superimposed loops in encircling relation about the load.

12. A self-cinching cargo sling adapted to encircle and supportingly engage a load to facilitate the lifting thereof and characterized by high strength, and the ability to resist the release of the cinched relationship about the load after the cinching or lifting force is released, and comprising a unitary elongate flexible load bearing member having a medial portion and an outer portion on each side of said medial portion, said medial portion being disposed in a loop, and said outer portions extending in opposing paths along the periphery of the loop and such that each outer portion has a first segment intimately contacting a portion of the periphery of the loop and a second segment extending to a terminal point positioned outwardly beyond the side of the loop which is opposite said intimately contacting portion, and means operatively associated with the load bearing member for maintaining said intimately contacting portions in a relatively slideable, contiguous relationship to thereby achieve a frictional engagement therebetween and comprising a pair of spaced apart slits in said member, with said slits being positioned at opposite sides of the loop when the sling is in its operative position about the load, and with a portion of the member extending through each of said slits, whereby the loop may be positioned to encircle a load, and a lifting force exerted on each of the outer portions from the associated terminal point to draw the loop into cinching relationship about the load and such that the frictional engagement between the intimately contacting portions serves to resist the release of the cinching force upon the release of the lifting force.

13. The cargo sling as defined in claim 12 wherein said load bearing member comprises a fabric webbing.

14. The cargo sling as defined in claim 13 wherein said pair of slits are each disposed in said loop of the member, with one of said outer portions extending through each of said slits.

15. A self-cinching cargo sling adapted to encircle and supportingly engage a load to facilitate the lifting thereof and characterized by high strength, and the ability to resist the release of the cinched relationship about the load after the cinching or lifting force is released, and comprising an endless flexible load bearing member arranged to define an inner loop and an outer loop disposed substantially about the inner loop, said inner and outer loops having overlapping portions which extend along a substantial part of the periphery of the inner loop.

means operatively associated with the load bearing member for maintaining the overlapping portions in a relatively slideable, contiguous relationship to thereby achieve a frictional engagement therebetween, and means for limiting the cinching force of the sling about the load, whereby the loops may be positioned to encircle a load, and a lifting force exerted on the outer loop to draw the inner loop into cinching relationship about the load and such that the frictional engagement between the overlappng portions serves to resist the release of the cinching force upon the release of the lifting force.

16. The cargo sling as defined in claim 15 wherein said limiting means comprises a pair of tabs interconnecting the non-overlapping portions of said loops, with said tabs being spaced apart so as to be adapted to be disposed on opposite sides of the point on the outer loop where the lifting force is applied.

* * * * *